US007974839B2

(12) United States Patent
Sung et al.

(10) Patent No.: US 7,974,839 B2
(45) Date of Patent: Jul. 5, 2011

(54) METHOD, MEDIUM, AND APPARATUS ENCODING SCALABLE WIDEBAND AUDIO SIGNAL

(75) Inventors: Ho-sang Sung, Yongin-si (KR); Eun-mi Oh, Yongin-si (KR); Kang-eun Lee, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 775 days.

(21) Appl. No.: 12/076,781

(22) Filed: Mar. 21, 2008

(65) Prior Publication Data

US 2009/0094023 A1 Apr. 9, 2009

(30) Foreign Application Priority Data

Oct. 9, 2007 (KR) ..... 10-2007-0101664

(51) Int. Cl.
*G10L 19/00* (2006.01)

(52) U.S. Cl. .... 704/219; 704/220; 704/500; 375/240.23

(58) Field of Classification Search ..... 704/219, 704/220, 500; 375/240.23
See application file for complete search history.

(56) References Cited

U.S. PATENT DOCUMENTS

| | | | | |
|---|---|---|---|---|
| 5,495,555 | A * | 2/1996 | Swaminathan | 704/207 |
| 5,596,676 | A * | 1/1997 | Swaminathan et al. | 704/208 |
| 5,890,108 | A * | 3/1999 | Yeldener | 704/208 |
| 7,587,312 | B2 * | 9/2009 | Kim | 704/205 |
| 2008/0052068 | A1 * | 2/2008 | Aguilar et al. | 704/230 |

* cited by examiner

*Primary Examiner* — Daniel D Abebe
(74) *Attorney, Agent, or Firm* — Staas & Halsey LLP

(57) ABSTRACT

Provided is a method and apparatus for encoding a scalable wideband audio signal, the method including: filtering a voiced signal by performing linear prediction on the voiced signal and modulating the filtered signal; encoding the modulated signal in the time domain, and outputting a core layer encoding result of the voiced signal; subtracting a signal obtained by decoding the core layer encoding result from the modulated signal and outputting an error signal; and encoding the error signal and outputting an enhancement layer encoding result of the voiced signal.

20 Claims, 8 Drawing Sheets

METHOD, MEDIUM, AND APPARATUS ENCODING SCALABLE WIDEBAND AUDIO SIGNAL

CROSS-REFERENCE TO RELATED PATENT APPLICATION

This application claims the benefit of Korean Patent Application No. 10-2007-0101664, filed on Oct. 9, 2007, in the Korean Intellectual Property Office, the disclosure of which is incorporated herein in its entirety by reference.

BACKGROUND

1. Field

One or more embodiments of the present invention relate to a method, medium, and apparatus encoding an audio signal, and more particularly to, a method, medium, and apparatus encoding a scalable wideband audio signal.

2. Description of the Related Art

Various applications of an audio communication and enhancement of a network transmission speed have resulted in an increase in demand for a high quality audio communication. Transmission of a wideband audio signal having a bandwidth between 0.05 kHz~7 kHz that has better performance in terms of naturalness and articulation than a conventional audio communication bandwidth between 0.3 kHz~3.4 kHz is needed.

A packet switching network that transmits data in units of packets may cause channel congestion, resulting in a packet loss and sound degradation. To address these problems, technologies for concealing damaged packets have been used, but these do not contribute to a fundamental solution.

Therefore, research into a scalable wideband audio encoding technology capable of effectively compressing a wideband audio signal and overcoming channel congestion has been recently conducted.

FIG. 1 is a block diagram of a conventional scalable codec. Referring to FIG. 1, the conventional scalable codec comprises a core layer codec 100, a subtractor 110, and an error signal encoder 120.

The core layer codec 100 encodes an input signal IN and decodes an encoding result. The subtractor 110 subtracts the encoding result that is output by the core layer codec 100 from the input signal IN. The error signal encoder 120 encodes an error signal that is output by the subtractor 110. Therefore, it is possible to enhance a signal to noise ratio (SNR) of a signal in the same band.

FIG. 2 is a block diagram of another conventional scalable codec. Referring to FIG. 2, the conventional scalable codec comprises a down-sampling unit 200, a low frequency band codec 210, an up-sampling unit 220, a high frequency band restoring unit 230, an adder 240, a subtractor 250, and an error signal encoding unit 260.

The down-sampling unit 200 down-samples an input signal IN and outputs a signal in a slightly lower band than that of the input signal IN as a core layer signal. For example, the band of the input signal IN is 8 kHz, and the band of the down-sampled signal is 6.4 kHz. The low frequency band codec 210 encodes the down-sampled signal that is the core layer signal and decodes an encoding result. An example of the low frequency band codec 210 is an adaptive multi rate-wideband (AMR-WB) codec. The up-sampling unit 220 up-samples an output of the low frequency band codec 210. The high frequency band restoring unit 230 restores a signal in a band that is encoded in the low frequency band codec 210. The adder 240 adds an output of the up-sampling unit 220 to an output of the high frequency band restoring unit 230. The subtractor 250 subtracts an output of the adder 240 from the input signal IN that is an original signal. The error signal encoding unit 260 encodes an error signal that is an output of the subtractor 250. Therefore, it is possible to enhance an SNR of a signal as a whole.

FIG. 3 is a block diagram of another conventional scalable codec. Referring to FIG. 3, the conventional scalable codec comprises a band dividing unit 300, a low frequency band codec 310, a high frequency band codec 320, first and second subtractors 330 and 340, and an error signal encoding unit 350.

The band dividing unit 300 equally divides a frequency band of an input signal IN and outputs a low frequency band signal and a high frequency band signal. The low frequency band codec 310 encodes the low frequency band signal that is a core scalable signal and decodes an encoding result. The high frequency band codec 320 encodes the high frequency band signal and decodes an encoding result. The high frequency band signal is additionally encoded, thereby enhancing sound quality. The first subtractor 330 subtracts an output result of the low frequency band codec 310 from the low frequency band signal. The second subtractor 340 subtracts an output result of the high frequency band codec 320 from the high frequency band signal. The error signal encoding unit 350 encodes an error signal that is output by the first and second subtractors 330 and 340. Therefore, it is possible to enhance the SNR of a signal in a whole band.

SUMMARY OF THE INVENTION

One or more embodiments of the present invention provide a method of encoding a scalable wideband audio signal capable of effectively compressing a wideband audio signal and enhancing sound quality in a core layer and an enhancement layer of the wideband audio signal, a computer readable recording medium storing a program for executing the method, and an apparatus for encoding a scalable wideband audio signal.

Additional aspects and/or advantages will be set forth in part in the description which follows and, in part, will be apparent from the description, or may be learned by practice of the invention.

According to an aspect of the present invention, there is provided a method of encoding a scalable wideband audio signal, the method including filtering a voiced signal by performing linear prediction on the voiced signal, and modulating the filtered signal, encoding the modulated signal in a time domain, and outputting a core layer encoding result of the voiced signal, subtracting a signal obtained by decoding the core layer encoding result from the modulated signal and outputting an error signal, and encoding the error signal and outputting an enhancement layer encoding result of the voiced signal.

According to another aspect of the present invention, there is provided a computer readable recording medium storing a computer readable program for executing a method of encoding a scalable wideband audio signal, the method including filtering a voiced signal by performing linear prediction on the voiced signal and modulating the filtered signal, encoding the modulated signal in a time domain, and outputting a core layer encoding result of the voiced signal, subtracting a signal obtained by decoding the core layer encoding result from the modulated signal and outputting an error signal, and encoding the error signal and outputting an enhancement layer encoding result of the voiced signal.

According to another aspect of the present invention, there is provided an apparatus for encoding a scalable wideband audio signal, the apparatus including a signal analysis unit to filter a voiced signal by performing linear prediction on the voiced signal, a signal modulation unit to modulate the filtered signal, a time domain encoding unit to encode the modulated signal in a time domain, and to output a core layer encoding result of the voiced signal, a time domain decoding unit to decode the core layer encoding result in the time domain, a subtractor to subtract the decoded signal from the modulated signal and to output an error signal, and an error signal encoding unit to encode the error signal and to output an enhancement layer encoding result of the voiced signal.

According to another aspect of the present invention, there is provided an apparatus for encoding a scalable wideband audio signal, the apparatus including a filtering unit to pre-emphasis filter a voiced signal, a signal analysis unit to filter the pre-emphasis filtered signal by performing linear prediction on the pre-emphasis filtered signal, a signal modulation unit to modulate the filtered signal, a time domain encoding unit to encode the modulated signal in a time domain, and to output a core layer encoding result of the voiced signal, a time domain decoding unit to decode the core layer encoding result in the time domain, an inverse-filtering unit to inversely filter the modulated signal, a subtractor to subtract the decoded signal from the inversely filtered signal and to output the error signal, and an error signal encoding unit to encode the error signal and to output an enhancement layer encoding result of the voiced signal.

According to another aspect of the present invention, there is provided an apparatus for encoding a scalable wideband audio signal, the apparatus including a down-sampling unit to down-sample a voiced signal at a predetermined sampling rate, a signal analysis unit to filter the down-sampled signal by performing linear prediction on the down-sampled signal, a signal modulation unit to modulate the filtered signal, a time domain encoding unit to encode the modulated signal in a time domain, and to output a core layer encoding result of the voiced signal, a time domain decoding unit to decode the core layer encoding result in the time domain, a band pass filtering unit to band pass filter the voiced signal in a predetermined frequency band excluding a frequency band of the down-sampled signal, an up-sampling unit to up-sample the modulated signal at an original sampling rate, an adder to add the band pass filtered signal and the up-sampled signal, a subtractor to subtract the decoded signal from the signal resulting from the addition and to output an error signal, and an error signal encoding unit to encode the error signal and to output an enhancement layer encoding result of the voiced signal.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE INVENTION

Figure 1:
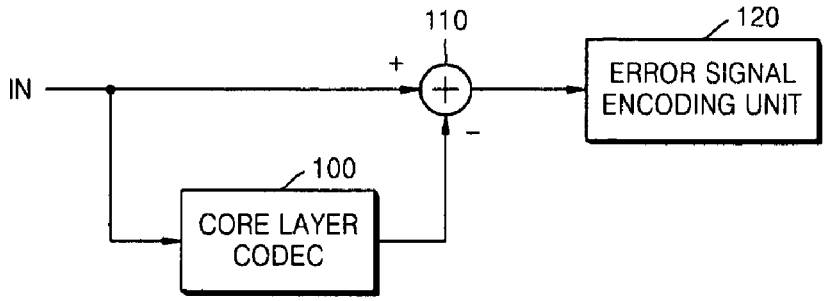
FIG. 1 (PRIOR ART)
FIG. 1 is a block diagram of a conventional scalable codec.
Figure 2:
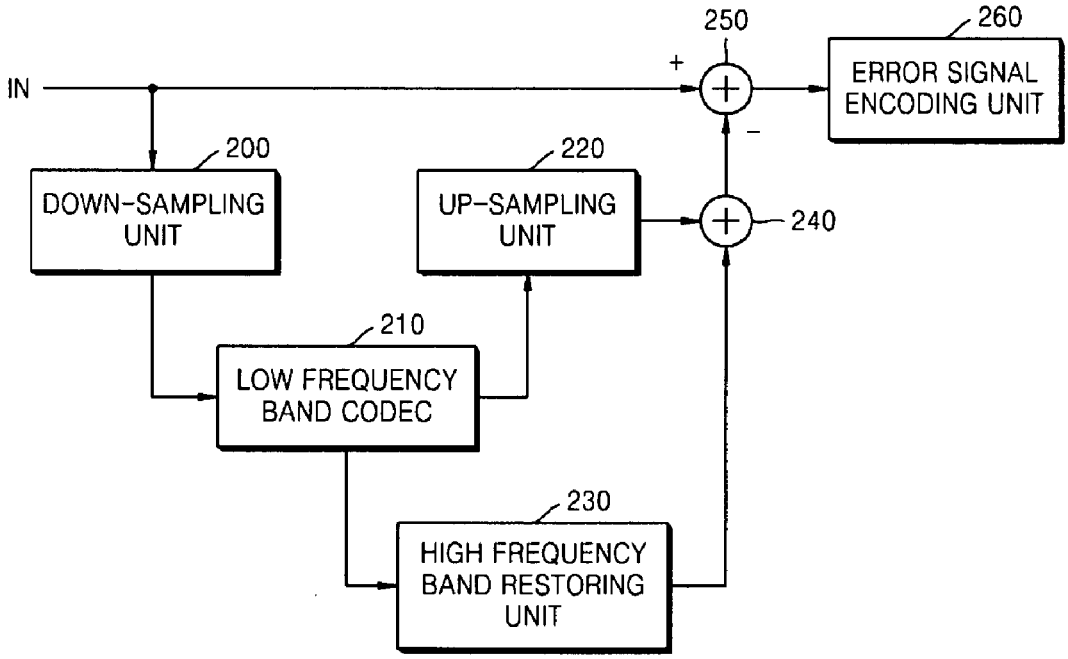
FIG. 2 (PRIOR ART)
FIG. 2 is a block diagram of another conventional scalable codec.
Figure 3:
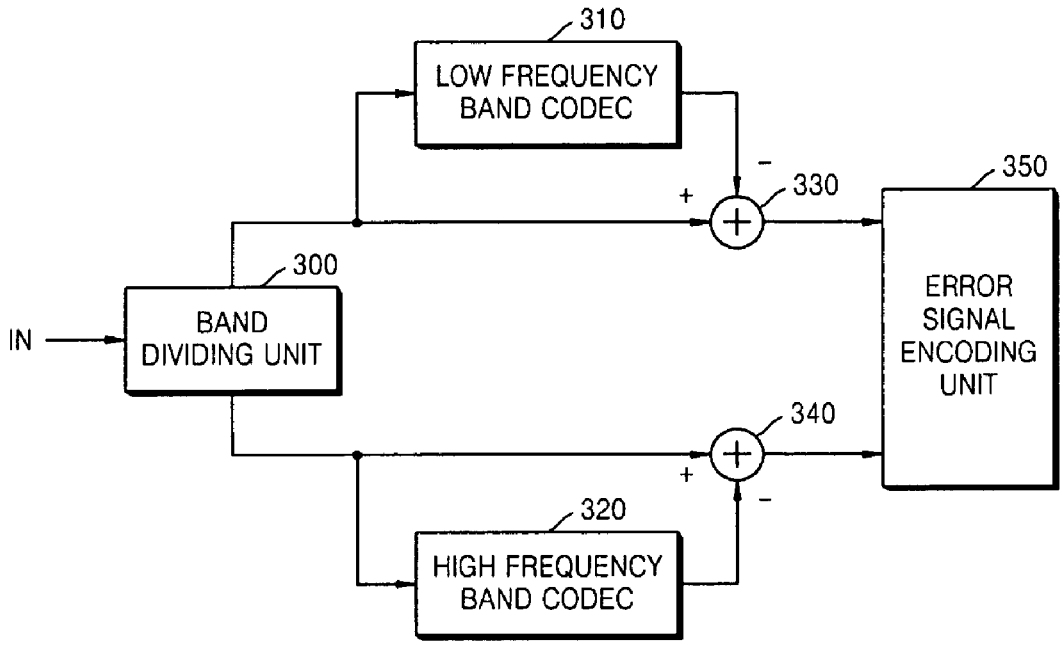
FIG. 3 (PRIOR ART)
FIG. 3 is a block diagram of another conventional scalable codec.

Reference will now be made in detail to embodiments, examples of which are illustrated in the accompanying drawings, wherein like reference numerals refer to the like elements throughout. In this regard, embodiments of the present invention may be embodied in many difference forms and should not be construed as being limited to embodiments set forth herein. Accordingly, embodiments are merely described below, by referring to the figures, to explain aspects of the present invention.

Figure 4:
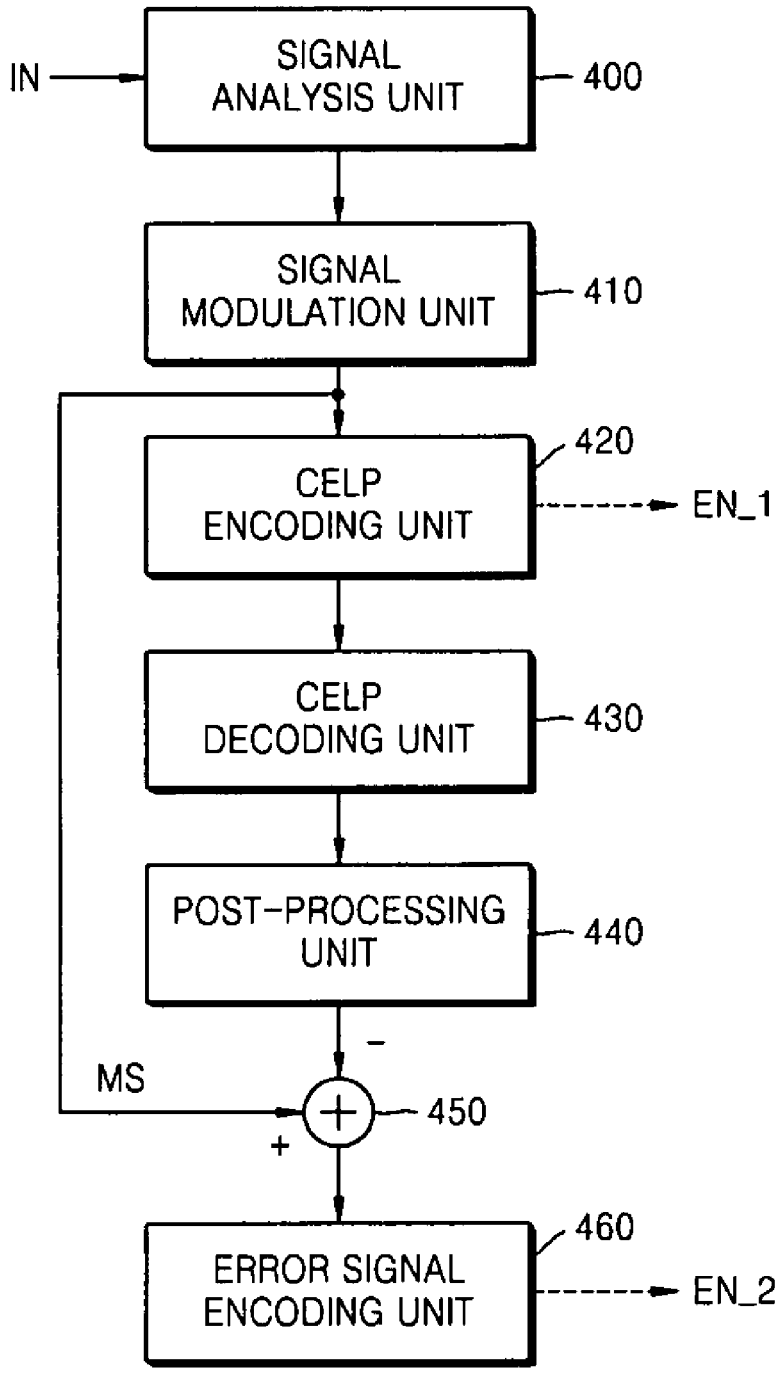
FIG. 4 is a block diagram of an apparatus for encoding a scalable wideband audio signal according to an embodiment of the present invention.

FIG. 4 is a block diagram of an apparatus for encoding a scalable wideband audio signal according to an embodiment of the present invention. Referring to FIG. 4, the apparatus for encoding the scalable wideband audio signal may include a signal analysis unit 400, a signal modulation unit 410, a code excited linear prediction (CELP) encoding unit 420, a CELP decoding unit 430, a post-processing unit 440, a subtractor 450, and an error signal encoding unit 460.

The signal analysis unit 400 filters a voiced signal IN that is received from outside by performing linear prediction on the voiced signal IN. In more detail, the signal analysis unit 400 calculates a coefficient of a linear prediction filter in order to produce a minimum error between an original voiced signal and a predicted voiced signal, and filters the voiced signal IN according to the coefficient of the linear prediction filter.

The voiced signal IN can be extracted from a pulse code modulation (PCM) signal that is a digital signal modulated from an analog speech or audio signal. According to another embodiment, the voiced signal IN may be a stationary voiced signal that is extracted from the PCM signal.

Although not shown, the apparatus for encoding the scalable wideband audio signal may further comprise a signal dividing unit. The signal dividing unit can divide the PCM signal into a voiced signal and a voiceless signal that is not the voiced signal. The signal dividing unit may further divide the PCM signal into a stationary voiced signal and a signal that is not the stationary voiced signal.

The signal modulation signal 410 modulates the signal that is filtered in the signal analysis unit 400. Therefore, a signal that is to be encoded in the CELP encoding unit 420 is corrected. In more detail, the signal modulation signal 410 obtains pitches from both edges of a frame that is a signal processing unit, linearly interpolates the pitches obtained from both edges of each frame and continuously and regularly modulates the filtered signal. Therefore, although pitches of the original input signal can be slightly changed, the signal modulation unit 410 modulates the signal that is output from the signal analysis unit 400 within the pitch variation range so that a human cannot recognize a difference between the original input signal and a modulated signal.

A pitch of a sound signal is usually referred to as the perceived fundamental frequency of the sound signal, i.e., a frequency of large peaks on a temporal axis, according to a regular vibration of the vocal cords. The pitch is a parameter that is very sensitive to the human auditory perception system and can be used to identify a speaker of the sound signal. Therefore, precise pitch analysis is a very important factor influencing the sound quality of a voice synthesis. In voice encoding, precise pitch analysis and restoration are decisive factors in the sound quality.

Since the pitch delay of a voiced signal tends to vary slowly, the signal modulation unit 410 modulates the filtered signal continuously and regularly by transmitting a pitch per every frame edge and linearly interpolating previously transmitted pitches and currently transmitted pitches in a sub frame included in each frame. Therefore, the CELP encoding unit 420 encodes so as to minimize the number of bits allocated to encode pitch information.

In more detail, the signal modulation unit 410 can increase contribution of an adaptive codebook for encoding the pitch information (that is, pitch gain and pitch lag) and reduce the number of bits allocated to a fixed codebook when the modulated signal is encoded by a CELP mode, thereby reducing the number of bits allocated to the voice encoding as a whole. Therefore, the number of bits used for the pitch information is minimized from a low bit rate by the signal modulation, thereby improving the sound quality as a whole.

The CELP encoding unit 420 encodes the signal modulated in the signal modulation unit 410 by a CELP mode and outputs a core layer encoding result EN_1. In more detail, the CELP encoding unit 420 does not encode the original voiced signal but encodes the signal modulated in the signal modulation unit 410, so that a signal that is to be encoded is modulated into the continuous and regular signal. The core layer represents information on the minimum sound quality that can be restored.

In this case, the CELP encoding unit 420 uses the CELP mode, which can be understood by one of ordinary skill in the art to which the present invention pertains, to encode the modulated signal in the present embodiment. Therefore, the CELP encoding unit 420 encodes the modulated signal, which is different from encoding in the time domain, and outputs the core layer encoding result EN_1.

In more detail, the CELP encoding unit 420 quantizes the coefficient of the linear prediction filter, which is output by the signal analysis unit 400, searches for the adaptive codebook and the fixed codebook with regard to the modulated signal, encodes pitch components of the modulated signal, and outputs the quantized coefficient of the linear prediction filter and the encoded pitch components as the core layer encoding result EN_1. For example, the encoded pitch components include pitch gain and pitch lag that are adaptive codebook search results and index and gain that are fixed codebook search results.

The CELP decoding unit 430 synthesizes the core layer encoding result that is output from the CELP encoding unit 420. In more detail, the CELP decoding unit 430 inversely quantizes the quantized coefficient of the linear prediction filter and generates a signal combining pitches and formants by using a pitch synthesis filter for synthesizing the encoded pitch components and a formant synthesis filter for synthesizing a formant component and the synthesized pitch component.

The post-processing unit 440 post-processes and inverse-filters the signal synthesized in the CELP decoding unit 430 to reduce the size of the synthesized signal excluding the formants and pitches. For example, the post-processing unit 440 can apply a post-filter to the signal synthesized in the CELP decoding unit 430 in order to reduce the size of the synthesized signal excluding the formants and pitch information. In this case, the post-processing unit 440 does not output the original voiced signal but instead, outputs a signal that distorts the original voiced signal.

The subtractor 450 calculates a difference between the signal that is modulated (MS) in the signal modulation unit 410 and the signal that is output by the post-processing unit 440 and outputs an error signal. In more detail, the subtractor 450 subtracts the signal that is output from the post-processing unit 440 from the MS of the signal modulation unit 410 and outputs the error signal. The subtractor 450 subtracts the signal that is output from the post-processing unit 440 from the MS of the signal modulation unit 410, instead of the original voiced signal, which reduces a variation of the error signal, thereby reducing a dynamic range that is a ratio of a strongest sound and a weakest sound of the error signal. The dynamic range presents the ratio of the strongest sound and the weakest sound in decibel when a sound signal is transmitted or recorded.

The error signal encoding unit 460 encodes the error signal that is output from the subtractor 450 and outputs an enhancement layer encoding result EN_2. Since the error signal does not have a great dynamic range as described above, the error signal encoding unit 460 can encode the error signal by using a small number of bits, thereby enhancing encoding efficiency. The enhanced scale represents additional information on the sound quality that can be enhanced.

Therefore, a decoding end decodes the core layer encoding result and the enhancement layer encoding result, thereby enhancing the sound quality as a whole.

Figure 5:
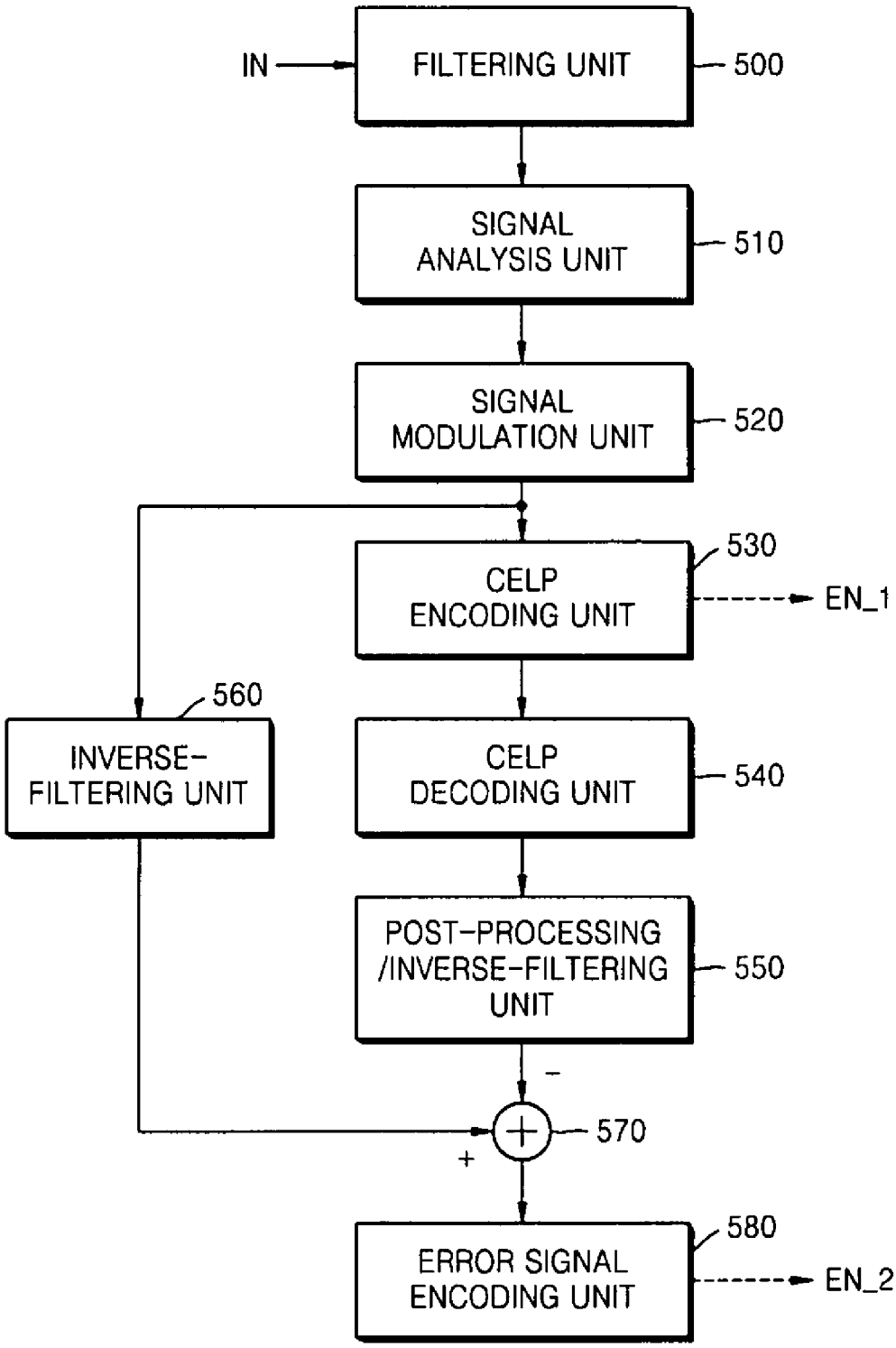
FIG. 5 is a block diagram of an apparatus for encoding a scalable wideband audio signal according to another embodiment of the present invention.

FIG. 5 is a block diagram of an apparatus for encoding a scalable wideband audio signal according to another embodiment of the present invention. Referring to FIG. 5, the apparatus for encoding the scalable wideband audio signal may include a filtering unit 500, a signal analysis unit 510, a signal modulation unit 520, a CELP encoding unit 530, a CELP decoding unit 540, a post-processing/inverse-filtering unit 550, an inverse-filtering unit 560, a subtractor 570, and an error signal encoding unit 580.

The filtering unit 500 filters a voiced signal IN that is received from outside. The voiced signal IN can be extracted from a PCM signal that is a digital signal modulated from an analog speech or audio signal. According to another embodiment, the voiced signal IN may be a stationary voiced signal that is extracted from the PCM signal.

Although not shown, the apparatus for encoding the scalable wideband audio signal may further comprise a signal dividing unit. The signal dividing unit can divide the PCM signal into a voiced signal and a voiceless signal that is not the voiced signal. The signal dividing unit may further divide the PCM signal into a stationary voiced signal and a signal that is not the stationary voiced signal.

In more detail, the filtering unit 500 pre-emphasis filters the voiced signal IN. Pre-emphasis filtering represents a previous distortion of an input signal according to the noise characteristic of a transmission path in order to enhance a signal-to-noise ratio (SNR). In more detail, the filtering unit 500 that passes signals of a whole band gives a weight to a high frequency band signal rather than a low frequency band signal when performing filtering. Therefore, a variation in a dynamic region of the voiced signal IN reduces a signal level (e.g., energy, amplitude, etc.) of the low frequency band signal, thereby reducing the number of bits allocated to voice encoding.

The signal analysis unit 510 filters the signal that is filtered in the filtering unit 500 by performing linear prediction on the signal. In more detail, the signal analysis unit 510 calculates a coefficient of a linear prediction filter in order to produce a minimum error between an original voiced signal and a predicted voiced signal, and filters the signal that is filtered in the filtering unit 500 according to the coefficient of the linear prediction filter.

The signal modulation signal 520 modulates the signal that is filtered in the signal analysis unit 510. Therefore, a signal that is to be encoded in the CELP encoding unit 530 is corrected. In more detail, the signal modulation signal 520 obtains pitches from both edges of a frame that is a signal processing unit, linearly interpolates the pitches obtained from both edges of each frame and continuously and regularly modulates the filtered signal. Therefore, although pitches of the original input signal can be slightly changed, the signal modulation unit 520 modulates the signal that is output from the signal analysis unit 510 within the pitch variation range so that a human cannot perceive a difference between the original input signal and a modulated signal.

Since the pitch delay of a voiced signal tends to vary slowly, the signal modulation unit 520 modulates the filtered signal continuously and regularly by transmitting a pitch per every frame edge and linearly interpolating previously transmitted pitches and currently transmitted pitches in a sub frame included in each. Therefore, the CELP encoding unit 530 encodes the modulated signal so as to minimize the number of bits allocated to encode pitch information.

The CELP encoding unit 530 encodes the signal modulated in the signal modulation unit 520 by a CELP mode and outputs a core layer encoding result EN_1. In more detail, the CELP encoding unit 530 does not encode the original voiced signal but encodes the signal modulated in the signal modulation unit 510, so that a signal that is to be encoded is modulated into the continuous and regular signal. The core layer represents information on the minimum sound quality that can be restored.

In this case, the CELP encoding unit 530 uses the CELP mode, which can be understood by one of ordinary skill in the art to which the present invention pertains, to encode the modulated signal in the present embodiment. Therefore, the CELP encoding unit 530 encodes the modulated signal, which is different from encoding in the time domain, and outputs the core layer encoding result EN_1.

In more detail, the CELP encoding unit 530 quantizes the coefficient of the linear prediction filter, which is output by the signal analysis unit 510, searches for the adaptive codebook and the fixed codebook with regard to the modulated signal, encodes pitch components of the modulated signal, and outputs the quantized coefficient of the linear prediction filter and the encoded pitch components as the core layer encoding result EN_1. For example, the encoded pitch components includes pitch gain and pitch lag that are adaptive codebook search results and index and gain that are fixed codebook search results.

The CELP decoding unit 540 synthesizes the core layer encoding result that is output from the CELP encoding unit 530. In more detail, the CELP decoding unit 540 inversely quantizes the quantized coefficient of the linear prediction filter and generates a signal combining pitches and formants by using a pitch synthesis filter for synthesizing the encoded pitch components and a formant synthesis filter for synthesizing a formant component and the synthesized pitch component.

The post-processing/inverse-filtering unit 550 post-processes and inverse-filters the signal synthesized in the CELP decoding unit 540 to reduce the size of the synthesized signal excluding the formants and pitches. For example, the post-processing/inverse-filtering unit 550 can apply a post-filter to the signal synthesized in the CELP decoding unit 540. Since the filtering unit 500 filters the voiced signal IN, the post-processing/inverse-filtering unit 550 inversely filters the voiced signal IN that is filtered in the filtering unit 500. In this case, the post-processing/inverse-filtering unit 550 does not output the original voiced signal but instead, outputs a signal that distorts the original voiced signal.

The inverse-filtering unit 560 inversely filters the signal that is modulated in the signal modulation unit 520. Since the filtering unit 500 filters the voiced signal IN, it is necessary to inversely filter the voiced signal IN that is filtered in the filtering unit 500.

The subtractor 570 calculates a difference between the signal that is inversely filtered in the inverse-filtering unit 560 and the signal that is output by the post-processing/inverse-filtering unit 550 and outputs an error signal. In more detail, the subtractor 570 subtracts the signal that is output from the post-processing/inverse-filtering unit 550 from the signal that is inversely filtered in the inverse-filtering unit 560 and outputs the error signal. The subtractor 570 subtracts the signal that is output by the post-processing/inverse-filtering unit 550 from the signal that is inversely filtered with regard to the signal that is modulated in the signal modulation unit 520, instead of the original voiced signal, which reduces a variation of the error signal, thereby reducing a dynamic range of the error signal.

The error signal encoding unit 580 encodes the error signal that is output from the subtractor 570 and outputs an enhancement layer encoding result EN_2. Since the error signal does not have a great dynamic range as described above, the error signal encoding unit 580 can encode the error signal by using a small number of bits, thereby enhancing encoding efficiency.

Figure 6:
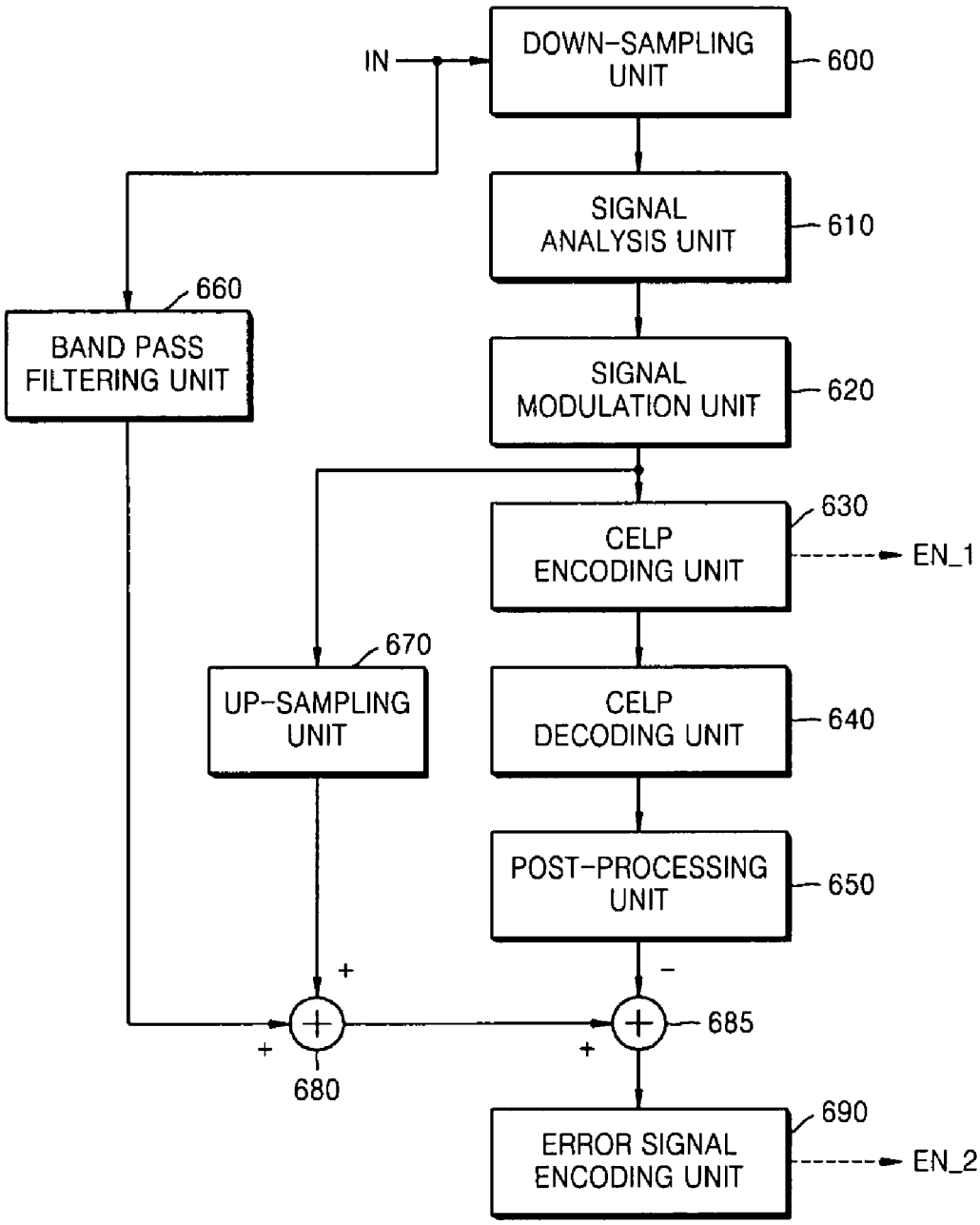
FIG. 6 is a block diagram of an apparatus for encoding a scalable wideband audio signal according to another embodiment of the present invention.

FIG. 6 is a block diagram of an apparatus for encoding a scalable wideband audio signal according to another embodiment of the present invention. Referring to FIG. 6, the apparatus for encoding the scalable wideband audio signal may include a down-sampling unit 600, a signal analysis unit 610, a signal modulation unit 620, a CELP encoding unit 630, a CELP decoding unit 640, a post-processing unit 650, a band pass filtering unit 660, an up-sampling unit 670, an adder 680, a subtractor 685, and an error signal encoding unit 690.

The down-sampling unit 600 down-samples a voiced signal IN that is received from outside. The voiced signal IN can be extracted from a PCM signal that is a digital signal modulated from an analog speech or audio signal. According to another embodiment, the voiced signal IN may be a stationary voiced signal that is extracted from the PCM signal.

Although not shown, the apparatus for encoding the scalable wideband audio signal may further comprise a signal dividing unit. The signal dividing unit can divide the PCM signal into a voiced signal and a voiceless signal that is not the voiced signal. The signal dividing unit may further divide the PCM signal into a stationary voiced signal and a signal that is not the stationary voiced signal.

The apparatus for encoding the scalable wideband audio signal encodes the voiced signal IN in a band between 50 Hz and 7 kHz. A sampling rate of the voiced signal IN may be 16 kHz according to Nyquist theory. Nyquist theory states that a sampling rate must be at least twice the bandwidth of signals being processed in order to prevent inter-signal inference in the transmission of a digital signal.

In more detail, the down-sampling unit 600 down-samples the sampling rate of the voiced signal IN from 16 kHz to 12.8 kHz in order to enhance encoding efficiency. The down-sampling is performed to reduce a sampling rate of a signal. Therefore, the signal that is output from the down-sampling unit 600 can be in a band of 6.4 kHz.

The signal analysis unit 610 filters the signal that is down-sampled in the down-sampling unit 600 by performing linear prediction on the signal. In more detail, the signal analysis unit 610 calculates a coefficient of a linear prediction filter in order to produce a minimum error between an original voiced signal and a predicted voiced signal, and filters the signal that is down-sampled in the down-sampling unit 600 according to the coefficient of the linear prediction filter.

The signal modulation signal 620 modulates the signal that is filtered in the signal analysis unit 610. Therefore, a signal that is to be encoded in the CELP encoding unit 630 is corrected. In more detail, the signal modulation signal 620 obtains pitches from both edges of a frame that is a signal processing unit, linearly interpolates the pitches obtained from both edges of each frame and continuously and regularly modulates the filtered signal. Therefore, although pitches of the original input signal can be slightly changed, the signal modulation unit 620 modulates the signal that is output from the signal analysis unit 610 within the pitch variation range so that a human cannot perceive a difference between the original input signal and a modulated signal.

Since the pitch delay of a voiced signal tends to vary slowly, the signal modulation unit 620 modulates the filtered signal continuously and regularly by transmitting a pitch per every frame edge and linearly interpolating previously transmitted pitches and currently transmitted pitches in a sub frame included in each frame. Therefore, the CELP encoding unit 630 encodes the modulated signal so as to minimize the number of bits allocated to encode pitch information.

The CELP encoding unit 630 encodes the signal modulated in the signal modulation unit 620 by a CELP mode and outputs a core layer encoding result EN_1. In more detail, the CELP encoding unit 630 does not encode the original voiced signal but encodes the signal modulated in the signal modulation unit 620, so that a signal that is to be encoded is modulated into the continuous and regular signal. The core layer represents information on the minimum sound quality that can be restored.

In this case, the CELP encoding unit 630 uses the CELP mode, which can be understood by one of ordinary skill in the art to which the present invention pertains, to encode the modulated signal in the present embodiment. Therefore, the CELP encoding unit 630 encodes the modulated signal, which is different from encoding in the time domain, and outputs a core layer codec index. The enhanced scale represents additional information on the sound quality that can be enhanced.

In more detail, the CELP encoding unit 630 quantizes the coefficient of the linear prediction filter, which is output by the signal analysis unit 610, searches for the adaptive codebook and the fixed codebook with regard to the modulated signal, encodes pitch components of the modulated signal, and outputs the quantized coefficient of the linear prediction filter and the encoded pitch components as the core layer encoding result EN_1. For example, the encoded pitch components includes pitch gain and pitch lag that are adaptive codebook search results and index and gain that are fixed codebook search results.

The CELP decoding unit 640 synthesizes the core layer encoding result that is output from the CELP encoding unit 630. In more detail, the CELP decoding unit 640 inversely quantizes the quantized coefficient of the linear prediction filter and generates a signal combining pitches and formants by using a pitch synthesis filter for synthesizing the encoded pitch components and a formant synthesis filter for synthesizing a formant component and the synthesized pitch component.

The post-processing unit 650 post-processes the signal synthesized in the CELP decoding unit 640 to reduce the size of the synthesized signal excluding the formants and pitches. For example, the post-processing unit 650 can apply a post-filter to the signal synthesized in the CELP decoding unit 640. In this case, the post-processing unit 650 does not output the original voiced signal but instead, outputs a signal that distorts the original voiced signal.

The band pass filtering unit 660 receives the voiced signal IN and filters the voiced signal IN in a band between 6.4 kHz and 7 kHz. Since the down-sampling unit 600 outputs a signal within a band of 6.4 kHz, the band pass filtering unit 660 can CELP encode the voiced signal IN within the band of 6.4 kHz. Therefore, the band pass filtering unit 660 filters the voiced signal IN in the band between 6.4 kHz and 7 kHz.

The up-sampling unit 670 up-samples the signal that is modulated in the signal modulation unit 620 at a sampling rate of 16 kHz that is a sampling rate of the original voiced signal.

The adder 680 adds the signals that are output from the band pass filtering unit 660 and the up-sampling unit 670. Therefore, the adder 680 outputs a signal in a whole band as in the original voiced signal IN.

The subtractor 685 calculates a difference between the signals that are output from the adder 680 and the post-processing unit 650 and outputs an error signal. In more detail, the subtractor 685 subtracts the signal that is output from the post-processing unit 650 from the signal that is output by the adder 680 and outputs the error signal. The subtractor 685 subtracts the signal that is output by the post-processing unit 650 from the signal obtained by adding the signal that is modulated in the signal modulation unit 620 to a signal of the original voiced signal IN in a band that is not modulated, instead of the original voiced signal, which reduces a variation of the error signal, thereby reducing a dynamic range of the error signal.

The error signal encoding unit 690 encodes the error signal that is output from the subtractor 685 and outputs an enhancement layer encoding result EN_2. Since the error signal does not have a great dynamic range as described above, the error signal encoding unit 690 can encode the error signal by using a small number of bits, thereby enhancing encoding efficiency.

Figure 7:
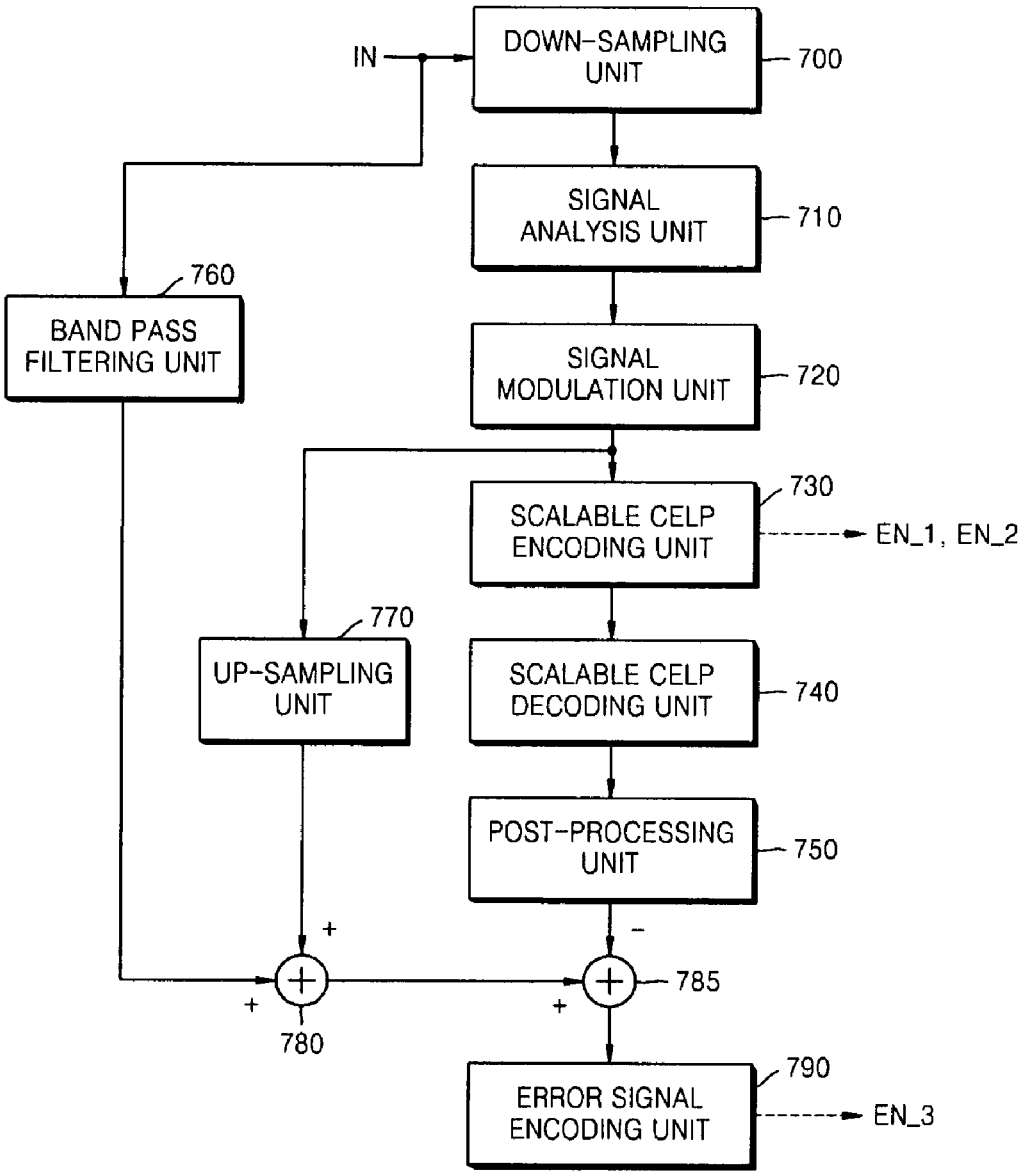
FIG. 7 is a block diagram of an apparatus for encoding a scalable wideband audio signal according to another embodiment of the present invention.

FIG. 7 is a block diagram of an apparatus for encoding a scalable wideband audio signal according to another embodiment of the present invention. Referring to FIG. 7, the apparatus for encoding the scalable wideband audio signal may include a down-sampling unit 700, a signal analysis unit 710, a signal modulation unit 720, a scalable CELP encoding unit 730, a scalable CELP decoding unit 740, a post-processing unit 750, a band pass filtering unit 760, an up-sampling unit 770, an adder 780, a subtractor 785, and an error signal encoding unit 790.

The down-sampling unit 700 down-samples a voiced signal IN that is received from outside. The voiced signal IN can be extracted from a PCM signal that is a digital signal modulated from an analog speech or audio signal. According to another embodiment, the voiced signal IN may be a stationary voiced signal that is extracted from the PCM signal.

Although not shown, the apparatus for encoding the scalable wideband audio signal may further comprise a signal dividing unit. The signal dividing unit can divide the PCM signal into a voiced signal and a voiceless signal that is not the voiced signal. The signal dividing unit may further divide the PCM signal into a stationary voiced signal and a signal that is not the stationary voiced signal.

The apparatus for encoding the scalable wideband audio signal encodes the voiced signal IN in a band between 50 Hz and 7 kHz. A sampling rate of the voiced signal IN may be 16 kHz according to Nyquist theory. Nyquist theory states that a sampling rate must be at least twice the bandwidth of signals being processed in order to prevent inter-signal inference in the transmission of a digital signal.

In more detail, the down-sampling unit 700 down-samples the sampling rate of the voiced signal IN from 16 kHz to 12.8 kHz in order to enhance encoding efficiency. The down-sampling is performed to reduce a sampling rate of a signal. Therefore, the signal that is output from the down-sampling unit 700 can be in a band of 6.4 kHz.

The signal analysis unit 710 filters the signal that is down-sampled in the down-sampling unit 700 by performing linear prediction on the signal. In more detail, the signal analysis unit 710 calculates a coefficient of a linear prediction filter in order to produce a minimum error between an original voiced signal and a predicted voiced signal, and filters the signal that is down-sampled in the down-sampling unit 700 according to the coefficient of the linear prediction filter.

The signal modulation signal 720 modulates the signal that is filtered in the signal analysis unit 710. Therefore, a signal that is to be encoded in the scalable CELP encoding unit 730 is corrected. In more detail, the signal modulation signal 720 obtains pitches from both edges of a frame that is a signal processing unit, linearly interpolates the pitches obtained from both edges of each frame and continuously and regularly modulates the filtered signal. Therefore, although pitches of the original input signal can be slightly changed, the signal modulation unit 720 modulates the signal that is output from the signal analysis unit 710 within the pitch variation range so that a human cannot perceive a difference between the original input signal and a modulated signal.

Since the pitch delay of a voiced signal tends to vary slowly, the signal modulation unit 720 modulates the filtered signal continuously and regularly by transmitting a pitch per every frame edge and linearly interpolating previously transmitted pitches and currently transmitted pitches in a sub frame included in each frame. Therefore, the scalable CELP encoding unit 730 encodes the modulated signal so as to minimize the number of bits allocated to encode pitch information.

The scalable CELP encoding unit 730 encodes the signal modulated in the signal modulation unit 720 by a scalable CELP mode and outputs a core layer index EN_1 and an enhancement layer index EN_2 as core layer encoding results. In more detail, the scalable CELP encoding unit 730 does not encode the original voiced signal but encodes the signal modulated in the signal modulation unit 720, so that a signal that is to be encoded is modulated into the continuous and regular signal. In more detail, the scalable CELP encoding unit 730 increases the number of bits allocated to voice encoding in order to enhance encoding accuracy of an input signal and thus scalably encodes the signal modulated in the signal modulation unit 720 and outputs the core layer index EN_1 and the enhancement layer index EN_2 as core layer encoding results.

In more detail, the scalable CELP encoding unit 730 quantizes the coefficient of the linear prediction filter, which is output by the signal analysis unit 710, searches for the adaptive codebook and the fixed codebook with regard to the modulated signal, encodes the modulated signal, and outputs the core layer index EN_1 and the enhancement layer index EN_2 as core layer encoding results. For example, the core layer index EN_1 includes the quantized linear prediction coefficient, pitch gain and pitch lag that are adaptive codebook search results and index and gain that are fixed codebook search results. Likewise, the enhancement layer index EN_2 includes the quantized linear prediction coefficient, pitch gain and pitch lag that are adaptive codebook search results and index and gain that are fixed codebook search results.

The scalable CELP decoding unit 740 synthesizes the core layer index EN_1 and the enhancement layer index EN_2 that are output from the scalable CELP encoding unit 730. In more detail, the scalable CELP decoding unit 740 inversely quantizes the quantized coefficient of the linear prediction filter included in the core layer index EN_1 and generates a signal combining pitches and formants by using a pitch synthesis filter for synthesizing the encoded pitch components and a formant synthesis filter for synthesizing a formant component and the synthesized pitch component. The scalable CELP decoding unit 740 inversely quantizes the quantized coefficient of the linear prediction filter included in the enhancement layer index EN_2 and generates a signal combining pitches and formants by using a pitch synthesis filter for synthesizing the encoded pitch components and a formant synthesis filter for synthesizing a formant component and the synthesized pitch component.

The post-processing unit 750 post-processes the signal synthesized in the scalable CELP decoding unit 740 to reduce the size of the synthesized signal excluding the formants and pitches. For example, the post-processing unit 750 can apply a post-filter to the signal synthesized in the scalable CELP decoding unit 740. In this case, the post-processing unit 750 does not output the original voiced signal but instead, outputs a signal that distorts the original voiced signal.

The band pass filtering unit 760 receives the voiced signal IN and filters the voiced signal IN in a band between 6.4 kHz and 7 kHz. Since the down-sampling unit 700 outputs a signal within a band of 6.4 kHz, the band pass filtering unit 760 can CELP encode the voiced signal IN within the band of 6.4 kHz. Therefore, the band pass filtering unit 760 filters the voiced signal IN in the band between 6.4 kHz and 7 kHz.

The up-sampling unit 770 up-samples the signal that is modulated in the signal modulation unit 720 at a sampling rate of 16 kHz that is a sampling rate of the original voiced signal.

The adder 780 adds the signals that are output from the band pass filtering unit 760 and the up-sampling unit 770. Therefore, the adder 780 outputs a signal in a whole band as in the original voiced signal IN.

The subtractor 785 calculates a difference between the signals that are output from the adder 780 and the post-processing unit 750 and outputs an error signal. In more detail, the subtractor 785 subtracts the signal that is output from the post-processing unit 750 from the signal that is output by the adder 780 and outputs the error signal. The subtractor 785 subtracts the signal that is output by the post-processing unit 750 from the signal obtained by adding the signal that is modulated in the signal modulation unit 720 to a signal of the original voiced signal IN in a band that is not modulated, instead of the original voiced signal, which reduces a variation of the error signal, thereby reducing a dynamic range of the error signal.

The error signal encoding unit 790 encodes the error signal that is output from the subtractor 785 and outputs an enhancement layer encoding result EN_3. Since the error signal does not have a great dynamic range as described above, the error signal encoding unit 790 can encode the error signal by using a small number of bits, thereby enhancing encoding efficiency.

Figure 8:
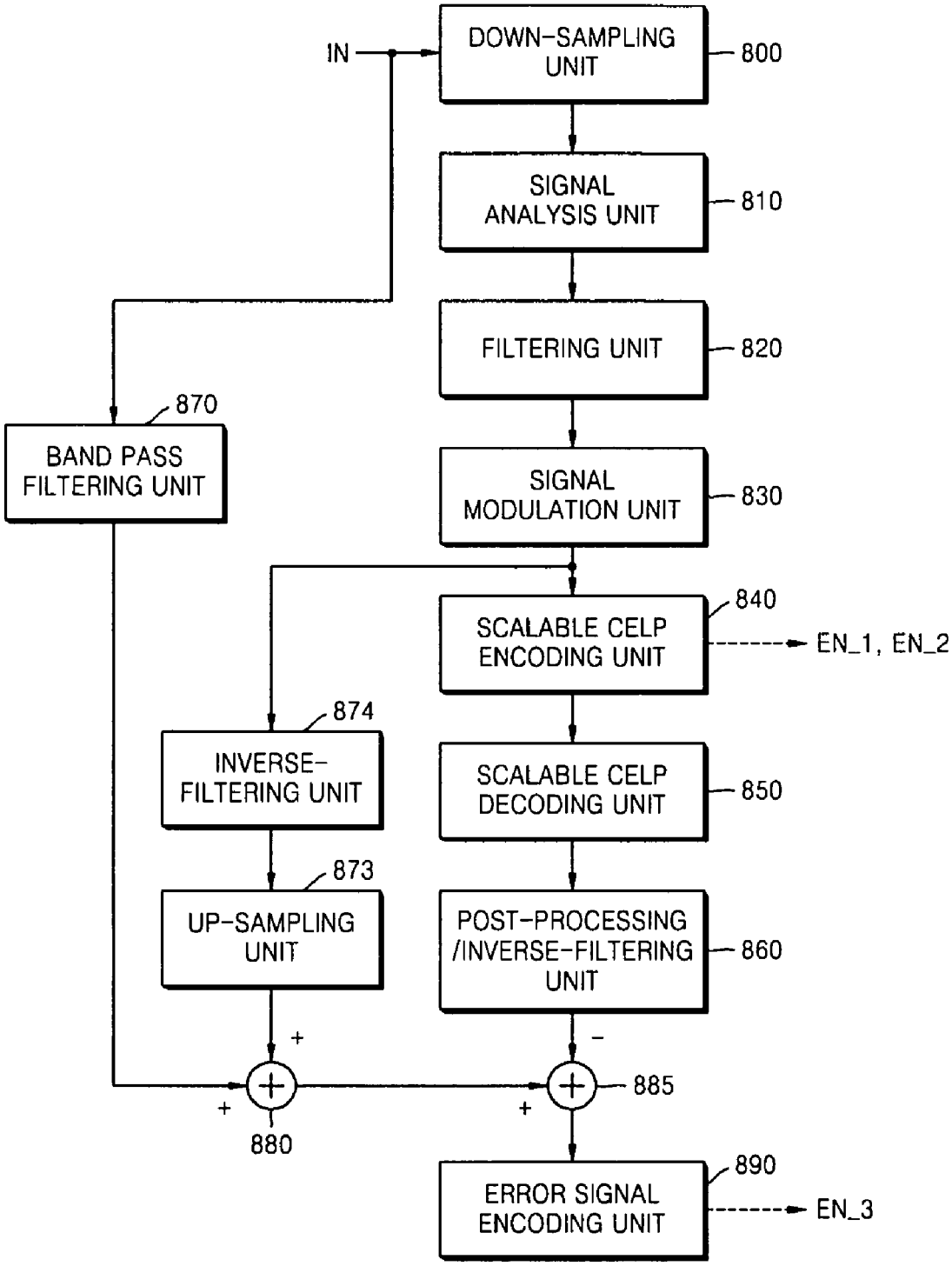
FIG. 8 is a block diagram of an apparatus for encoding a scalable wideband audio signal according to another embodiment of the present invention.

FIG. 8 is a block diagram of an apparatus for encoding a scalable wideband audio signal according to another embodiment of the present invention. Referring to FIG. 8, the apparatus for encoding the scalable wideband audio signal may include a down-sampling unit 800, a filtering unit 810, a signal analysis unit 820, a signal modulation unit 830, a scalable CELP encoding unit 840, a scalable CELP decoding unit 850, a post-processing/inverse-filtering unit 860, a band pass filtering unit 870, an inverse-filtering unit 874, an up-sampling unit 878, an adder 880, a subtractor 885, and an error signal encoding unit 890.

The down-sampling unit 800 down-samples a voiced signal IN that is received from outside. The voiced signal IN can be extracted from a PCM signal that is a digital signal modulated from an analog speech or audio signal. According to another embodiment, the voiced signal IN may be a stationary voiced signal that is extracted from the PCM signal.

Although not shown, the apparatus for encoding the scalable wideband audio signal may further comprise a signal dividing unit. The signal dividing unit can divide the PCM signal into a voiced signal and a voiceless signal that is not the voiced signal. The signal dividing unit may further divide the PCM signal into a stationary voiced signal and a signal that is not the stationary voiced signal.

The apparatus for encoding the scalable wideband audio signal encodes the voiced signal IN in a band between 50 Hz and 7 kHz. A sampling rate of the voiced signal IN may be 16 kHz according to Nyquist theory. Nyquist theory states that a sampling rate must be at least twice the bandwidth of signals being processed in order to prevent inter-signal inference in the transmission of a digital signal.

In more detail, the down-sampling unit 800 down-samples the sampling rate of the voiced signal IN from 16 kHz to 12.8 kHz in order to enhance encoding efficiency. The down-sampling is performed to reduce a sampling rate of a signal. Therefore, the signal that is output from the down-sampling unit 800 can be in a band of 6.4 kHz.

In more detail, the filtering unit 800 pre-emphasis filters the voiced signal IN. Pre-emphasis filtering represents a previous distortion of an input signal according to the noise characteristic of a transmission path in order to enhance a signal-to-noise ratio (SNR). In more detail, the filtering unit 500 that passes signals of a whole band gives a weight to a high frequency band signal rather than a low frequency band signal when performing filtering. Therefore, a variation in a dynamic region of the voiced signal IN reduces a signal level (e.g., energy, amplitude, etc.) of the low frequency band signal, thereby reducing the number of bits allocated to voice encoding.

The signal analysis unit 820 filters the signal that is filtered in the filtering unit 810 by performing linear prediction on the signal. In more detail, the signal analysis unit 820 calculates a coefficient of a linear prediction filter in order to produce a minimum error between an original voiced signal and a predicted voiced signal, and filters the signal that is filtered in the filtering unit 810 according to the coefficient of the linear prediction filter.

The signal modulation signal 830 modulates the signal that is filtered in the signal analysis unit 820. Therefore, a signal that is to be encoded in the scalable CELP encoding unit 840 is corrected. In more detail, the signal modulation signal 830 obtains pitches from both edges of a frame that is a signal processing unit, linearly interpolates the pitches obtained from both edges of each frame and continuously and regularly modulates the filtered signal. Therefore, although pitches of the original input signal can be slightly changed, the signal modulation unit 830 modulates the signal that is output from the signal analysis unit 820 within the pitch variation range so that a human cannot perceive a difference between the original input signal and a modulated signal.

Since the pitch delay of a voiced signal tends to vary slowly, the signal modulation unit 830 modulates the filtered signal continuously and regularly by transmitting a pitch per every frame edge and linearly interpolating previously transmitted pitches and currently transmitted pitches in a sub frame included in each frame. Therefore, the scalable CELP encoding unit 840 encodes the modulated signal so as to minimize the number of bits allocated to encode pitch information.

The scalable CELP encoding unit 840 encodes the signal modulated in the signal modulation unit 830 by a scalable CELP mode and outputs a core layer index EN_1 and an enhancement layer index EN_2 as core layer encoding results. In more detail, the scalable CELP encoding unit 840 does not encode the original voiced signal but encodes the signal modulated in the signal modulation unit 830, so that a signal that is to be encoded is modulated into the continuous and regular signal. In more detail, the scalable CELP encoding unit 840 increases the number of bits allocated to voice encoding in order to enhance encoding accuracy of an input signal and thus scalably encodes the signal modulated in the signal modulation unit 830 and outputs the core layer index EN_1 and the enhancement layer index EN_2 as core layer encoding results of the voiced signal.

In more detail, the scalable CELP encoding unit 840 quantizes the coefficient of the linear prediction filter, which is output by the signal analysis unit 820, searches for the adaptive codebook and the fixed codebook with regard to the modulated signal, encodes the modulated signal, and outputs the core layer index EN_1 and the enhancement layer index EN_2 as core layer encoding results. For example, the core layer index EN_1 includes the quantized linear prediction coefficient, pitch gain and pitch lag that are adaptive codebook search results and index and gain that are fixed codebook search results. Likewise, the enhancement layer index EN_2 includes the quantized linear prediction coefficient, pitch gain and pitch lag that are adaptive codebook search results and index and gain that are fixed codebook search results.

The scalable CELP decoding unit 850 synthesizes the core layer index EN_1 and the enhancement layer index EN_2 that are output from the scalable CELP encoding unit 840. In more detail, the scalable CELP decoding unit 850 inversely quantizes the quantized coefficient of the linear prediction filter included in the core layer index EN_1 and generates a signal combining pitches and formants by using a pitch synthesis filter for synthesizing the encoded pitch components and a formant synthesis filter for synthesizing a formant component and the synthesized pitch component. The scalable CELP decoding unit 850 inversely quantizes the quantized coefficient of the linear prediction filter included in the enhancement layer index EN_2 and generates a signal combining pitches and formants by using a pitch synthesis filter for synthesizing the encoded pitch components and a formant synthesis filter for synthesizing a formant component and the synthesized pitch component.

The post-processing/inverse-filtering unit 860 post-processes and inverse-filters the signal synthesized in the scalable CELP decoding unit 850. For example, the post-processing/inverse-filtering unit 860 can apply a post-filter to the signal synthesized in the scalable CELP decoding unit 850. Since the filtering unit 810 filters the down-sampled signal, the post-processing/inverse-filtering unit 860 inversely filters the down-sampled signal that is filtered in the filtering unit

810. In this case, the post-processing/inverse-filtering unit 860 does not output the original voiced signal but instead, outputs a signal that distorts the original voiced signal.

The band pass filtering unit 870 receives the voiced signal IN and filters the voiced signal IN in a band between 6.4 kHz and 7 kHz. Since the down-sampling unit 800 outputs a signal within a band of 6.4 kHz, the band pass filtering unit 870 can CELP encode the voiced signal IN within the band of 6.4 kHz. Therefore, the band pass filtering unit 870 filters the voiced signal IN in the band between 6.4 kHz and 7 kHz.

The inverse-filtering unit 874 inversely filters the signal that is modulated in the signal modulation unit 830. Since the filtering unit 810 filters the down-sampled signal, it is necessary to inversely filter the down-sampled signal that is filtered in the filtering unit 810.

The up-sampling unit 878 up-samples the signal that is inversely filtered in the inverse-filtering unit 874 at a sampling rate of 16 kHz that is a sampling rate of the original voiced signal.

The adder 880 adds the signals that are output from the band pass filtering unit 860 and the up-sampling unit 878. Therefore, the adder 880 outputs a signal in a whole band as in the original voiced signal IN.

The subtractor 885 calculates a difference between the signals that are output from the adder 880 and the post-processing/inverse-filtering unit 860 and outputs an error signal. In more detail, the subtractor 885 subtracts the signal that is output from the post-processing/inverse-filtering unit 860 from the signal that is output by the adder 880 and outputs the error signal. The subtractor 885 subtracts the signal that is output by the post-processing/inverse-filtering unit 860 from the signal obtained by adding the signal that is modulated in the signal modulation unit 830 to a signal of the original voiced signal IN in a band that is not modulated, instead of the original voiced signal, which reduces a variation of the error signal, thereby reducing a dynamic range of the error signal.

The error signal encoding unit 890 encodes the error signal that is output from the subtractor 885 and outputs an enhancement layer encoding result EN_3. Since the error signal does not have a great dynamic range as described above, the error signal encoding unit 890 can encode the error signal by using a small number of bits, thereby enhancing encoding efficiency.

Figure 9:
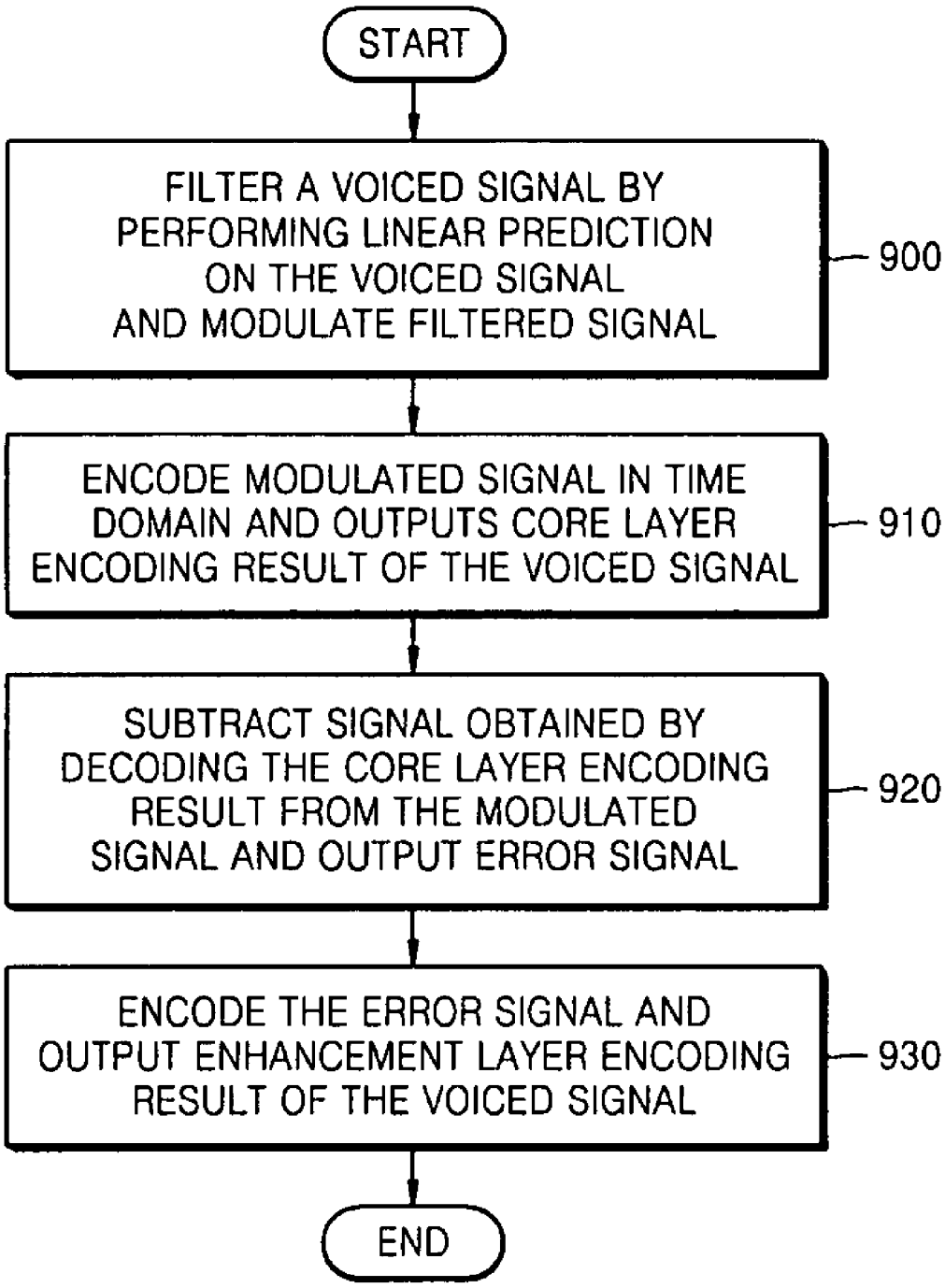
FIG. 9 is a flowchart illustrating a method of encoding a scalable wideband audio signal according to an embodiment of the present invention.

FIG. 9 is a flowchart illustrating a method of encoding a scalable wideband audio signal according to an embodiment of the present invention. Referring to FIG. 9, the method of encoding the scalable wideband audio signal comprises operations that are sequentially performed in the apparatus for encoding the scalable wideband audio signal shown in FIG. 4. Although not described, the description of the apparatus for encoding the scalable wideband audio signal shown in FIG. 4 is applied to the method of encoding the scalable wideband audio signal of the present embodiment.

In operation 900, the signal analysis unit 400 filters a voiced signal IN that is received from outside by performing linear prediction on the voiced signal, and the signal modulation signal 410 modulates the filtered signal. According to another embodiment, the voiced signal IN is filtered, the linear prediction analysis is performed with regard to the filtered signal and the linear prediction analyzed signal is filtered, and the filtered signal is modulated in operation 900. According to another embodiment, the voiced signal IN is down-sampled, the linear prediction analysis is performed with regard to the down-sampled signal and the linear prediction analyzed signal is filtered, and the filtered signal is modulated in operation 900. According to another embodiment, the voiced signal IN is down-sampled, the down-sampled signal is filtered, the linear prediction analysis is performed with regard to the filtered signal, the linear prediction analyzed signal is filtered, and the filtered signal is modulated in operation 900.

In operation 910, the CELP encoding unit 420 encodes the modulated signal in the time domain and outputs a core layer encoding result of the voiced signal. In this case, the CELP encoding unit 420 encodes the modulated signal by a CELP mode. According to another embodiment, the modulated signal is encoded by a scalable CELP mode, and a core layer index and an enhancement layer index are output as the core layer encoding results in operation 910.

In operation 920, the subtractor 450 subtracts a signal obtained by decoding the core layer encoding result from the modulated signal and outputs an error signal. According to another embodiment, the modulated signal is inversely filtered, the signal obtained by decoding the core layer encoding result is subtracted from the inversely filtered signal, and the error signal is output in operation 920. According to another embodiment, the voiced signal in a predetermined frequency band is band pass filtered, the modulated signal is up-sampled, the band pass filtered signal and the up-sampled signal are added, the signal obtained by decoding the core layer encoding result is subtracted from the signal resulting from the addition, and the error signal is output in operation 920. According to another embodiment, the voiced signal in a predetermined frequency band is band pass filtered, the modulated signal is inversely filtered, the inversely filtered signal is up-sampled, the band pass filtered signal and the up-sampled signal are added, the signal obtained by decoding the core layer encoding result is subtracted from the signal resulting from the addition, and the error signal is output in operation 920.

In operation 930, the error signal encoding unit 460 encodes the error signal and outputs an enhancement layer encoding result of the voiced signal.

The method of encoding the scalable wideband audio signal further comprises multiplexing the core layer encoding result and the enhancement layer encoding result as a bitstream and outputting the bitstream as encoding results of the voiced signal.

The present invention filters a voiced signal by performing linear prediction on the voiced signal, modulates the filtered signal, encodes the modulated signal in the time domain, outputs an encoding result of a core layer voiced signal, subtracts a decoded signal of an encoding result of the core layer voiced signal from the modulated signal, outputs an error signal, encodes the error signal, and outputs an encoding result of an enhancement layer voiced signal, so that both core basic and enhancement layer of voiced signals can be encoded using a small amount of bits, thereby enhancing sound quality of a whole voiced signal.

In more detail, an encoded/decoded signal of a modulated signal is subtracted from the modulated signal other than an original voiced signal and an error signal is generated and thus the error signal does not have a great variation width. Therefore, the error signal does not have a great dynamic range, and thus the error signal does not have a great encoding load, thereby reducing degradation of sound quality of an enhancement layer in spite of the small amount of bits. Therefore, sound quality of voiced signals including both core and enhancement layers is enhanced, thereby enhancing sound quality of an apparatus for encoding a wideband audio signal.

In addition to the above described embodiments, embodiments of the present invention can also be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including recording media, such as magnetic storage media (e.g., ROM, floppy disks, hard disks, etc.) and optical recording media (e.g., CD-ROMs, or DVDs), and transmission media such as carrier waves, as well as through the Internet, for example. Thus, the medium may further be a signal, such as a resultant signal or bitstream, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

While aspects of the present invention has been particularly shown and described with reference to differing embodiments thereof, it should be understood that these exemplary embodiments should be considered in a descriptive sense only and not for purposes of limitation. Any narrowing or broadening of functionality or capability of an aspect in one embodiment should not considered as a respective broadening or narrowing of similar features in a different embodiment, i.e., descriptions of features or aspects within each embodiment should typically be considered as available for other similar features or aspects in the remaining embodiments.

Thus, although a few embodiments have been shown and described, it would be appreciated by those skilled in the art that changes may be made in these embodiments without departing from the principles and spirit of the invention, the scope of which is defined in the claims and their equivalents.

What is claimed is:

1. A method of encoding a scalable wideband audio signal, the method comprising:

filtering a voiced signal by performing linear prediction on the voiced signal, and modulating the filtered signal;

encoding the modulated signal in a time domain, and outputting a core layer encoding result of the voiced signal;

subtracting a signal obtained by decoding the core layer encoding result from the modulated signal and outputting an error signal; and encoding the error signal and outputting an enhancement layer encoding result of the voiced signal.

2. The method of claim 1, further comprising: multiplexing the core layer encoding result and the enhancement layer encoding result as a bitstream and outputting the bitstream as encoding results of the voiced signal.

3. The method of claim 1, wherein the outputting of the core layer encoding result of the voiced signal comprises: encoding the modulated signal by a code excited linear prediction (CELP) mode so as to output the core layer encoding result.

4. The method of claim 1, further comprising: pre-emphasis filtering the voiced signal, wherein the modulating of the filtered signal comprises: filtering the pre-emphasis filtered signal by performing linear prediction on the pre-emphasis filtered signal and modulating the filtered signal.

5. The method of claim 4, further comprising: inversely filtering the modulated signal, wherein the outputting of the error signal comprises: subtracting the signal obtained by decoding the core layer encoding result from the inversely filtered signal and outputting the error signal.

6. The method of claim 1, further comprising: down-sampling the voiced signal at a predetermined sampling rate, wherein the modulating of the filtered signal comprises: filtering the down-sampled signal by performing linear prediction on the down-sampled signal and modulating the filtered signal.

7. The method of claim 6, further comprising:

band pass filtering the voiced signal in a predetermined frequency band excluding a frequency band of the down-sampled signal;

up-sampling the modulated signal at an original sampling rate; and adding the band pass filtered signal and the up-sampled signal, wherein the outputting of the error signal comprises: subtracting the signal obtained by decoding the core layer encoding result from the signal resulting from the addition and outputting the error signal.

8. The method of claim 6, wherein the outputting of the core layer encoding result of the voiced signal comprises: encoding the modulated signal by a scalable CELP mode and outputting a core layer index and an enhancement layer index as the core layer encoding result.

9. The method of claim 1, further comprising: down-sampling the voiced signal at a predetermined sampling rate; and pre-emphasis filtering the down-sampled signal, wherein the modulating of the filtered signal comprises: filtering the pre-emphasis filtered signal by performing linear prediction on the pre-emphasis filtered signal and modulating the filtered signal.

10. The method of claim 9, further comprising:

band pass filtering the voiced signal in a predetermined frequency band excluding the frequency band of the down-sampled signal;

inversely filtering the modulated signal;

up-sampling the inversely filtered signal at an original sampling rate; and adding the band pass filtered signal and the up-sampled signal, wherein the outputting of the error signal comprises: subtracting the signal obtained by decoding the core layer encoding result from the signal resulting from the addition and outputting the error signal.

11. The method of claim 9, wherein the outputting of the core layer codec index comprises: encoding the modulated signal by a scalable CELP mode and outputting a core layer index and an enhancement layer index as the core layer encoding result.

12. The method of claim 11, further comprising:

band pass filtering the voiced signal in a predetermined frequency band excluding the frequency band of the down-sampled signal;

inversely filtering the modulated signal;

up-sampling the inversely filtered signal at an original sampling rate; and adding the band pass filtered signal and the up-sampled signal, wherein the outputting of the error signal comprises: subtracting a signal obtained by decoding the core layer index and the enhancement layer index from the signal resulting from the addition and outputting the error signal.

13. A computer readable recording medium storing a computer readable program for executing a method of encoding a scalable wideband audio signal, the method comprising:

filtering a voiced signal by performing linear prediction on the voiced signal and modulating the filtered signal;

encoding the modulated signal in a time domain, and outputting a core layer encoding result of the voiced signal;

subtracting a signal obtained by decoding the core layer encoding result from the modulated signal and outputting an error signal; and encoding the error signal and outputting an enhancement layer encoding result of the voiced signal.

14. An apparatus for encoding a scalable wideband audio signal, the apparatus comprising:

a signal analysis unit to filter a voiced signal by performing linear prediction on the voiced signal;

a signal modulation unit to modulate the filtered signal;

a time domain encoding unit to encode the modulated signal in a time domain, and to output a core layer encoding result of the voiced signal;

a time domain decoding unit to decode the core layer encoding result in the time domain;

a subtractor to subtract the decoded signal from the modulated signal and to output an error signal; and an error signal encoding unit to encode the error signal and to output an enhancement layer encoding result of the voiced signal.

15. The apparatus of claim 14, wherein the time domain encoding unit encodes the modulated signal by a CELP mode and outputs the core layer encoding result, and wherein the time domain decoding unit decodes the core layer encoding result by the CELP mode.

16. The apparatus of claim 14, further comprising: a multiplexer to multiplex the core layer encoding result and the enhancement layer encoding result as a bitstream.

17. An apparatus for encoding a scalable wideband audio signal, the apparatus comprising:

a filtering unit to pre-emphasis filter a voiced signal;

a signal analysis unit to filter the pre-emphasis filtered signal by performing linear prediction on the pre-emphasis filtered signal;

a signal modulation unit to modulate the filtered signal;

a time domain encoding unit to encode the modulated signal in a time domain, and to output a core layer encoding result of the voiced signal;

a time domain decoding unit to decode the core layer encoding result in the time domain;

an inverse-filtering unit to inversely filter the modulated signal;

a subtractor to subtract the decoded signal from the inversely filtered signal and to output the error signal; and an error signal encoding unit to encode the error signal and to output an enhancement layer encoding result of the voiced signal.

18. An apparatus for encoding a scalable wideband audio signal, the apparatus comprising:

a down-sampling unit to down-sample a voiced signal at a predetermined sampling rate;

a signal analysis unit to filter the down-sampled signal by performing linear prediction on the down-sampled signal;

a signal modulation unit to modulate the filtered signal;

a time domain encoding unit to encode the modulated signal in a time domain, and to output a core layer encoding result of the voiced signal;

a time domain decoding unit to decode the core layer encoding result in the time domain;

a band pass filtering unit to band pass filter the voiced signal in a predetermined frequency band excluding a frequency band of the down-sampled signal;

an up-sampling unit to up-sample the modulated signal at an original sampling rate;

an adder to add the band pass filtered signal and the up-sampled signal;

a subtractor to subtract the decoded signal from the signal resulting from the addition and to output an error signal; and an error signal encoding unit to encode the error signal and to output an enhancement layer encoding result of the voiced signal.

19. The apparatus of claim 18, wherein the time domain encoding unit encodes the modulated signal by a CELP mode and outputs the core layer encoding result, and wherein the time domain decoding unit decodes the core layer encoding result by the CELP mode.

20. The apparatus of claim 18, wherein the time domain encoding unit encodes the modulated signal by a scalable CELP mode and outputs a core layer index and an enhancement layer index as the core layer encoding result, wherein the time domain decoding unit decodes the core layer index and the enhancement layer index.

* * * * *

UNITED STATES PATENT AND TRADEMARK OFFICE

CERTIFICATE OF CORRECTION

PATENT NO. : 7,974,839 B2
APPLICATION NO. : 12/076781
DATED : July 5, 2011
INVENTOR(S) : Ho-sang Sung et al.

It is certified that error appears in the above-identified patent and that said Letters Patent is hereby corrected as shown below:

Title Page, Item (75) (Inventors), Line 2, Delete "Yongin-si (KR)" and insert -- Seongnam-si (KR) --, therefor.

Signed and Sealed this
Nineteenth Day of June, 2012

David J. Kappos

David J. Kappos
*Director of the United States Patent and Trademark Office*